US006989753B1

(12) United States Patent
Lamming et al.

(10) Patent No.: US 6,989,753 B1
(45) Date of Patent: Jan. 24, 2006

(54) METHOD OF AND COMPUTER FOR IDENTIFYING REMINDER EVENT

(75) Inventors: Michael George Lamming, Palo Alto, CA (US); Denis William Bohm, Los Altos, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 81 days.

(21) Appl. No.: 10/734,444

(22) Filed: Dec. 12, 2003

(51) Int. Cl.
*G08B 13/00* (2006.01)

(52) U.S. Cl. ..... 340/573.1; 340/539.11; 340/539.13; 340/572.1

(58) Field of Classification Search ..... 340/539.1–539.19, 573.1, 573.4, 572.1, 340/825.36, 825.49; 600/300–301; 705/14
See application file for complete search history.

(56) References Cited

U.S. PATENT DOCUMENTS

| | | | | |
|---|---|---|---|---|
| 5,528,248 | A | 6/1996 | Steiner et al. | |
| 5,627,548 | A | 5/1997 | Woo et al. | |
| 5,699,244 | A | 12/1997 | Clark, Jr. et al. | |
| 5,877,724 | A | 3/1999 | Davis | |
| 5,902,347 | A | 5/1999 | Backman et al. | |
| 5,938,721 | A | 8/1999 | Dussell et al. | |
| 6,130,602 | A | 10/2000 | O'Toole et al. | |
| 6,232,870 | B1 | 5/2001 | Garber et al. | |
| 6,563,417 | B1 | 5/2003 | Shaw | |
| 6,587,835 | B1 | 7/2003 | Treyz et al. | |
| 6,681,989 | B2 | 1/2004 | Bodin | |
| 6,700,533 | B1 | 3/2004 | Werb et al. | |
| 6,703,930 | B2 | 3/2004 | Skinner | |
| 6,727,818 | B1 * | 4/2004 | Wildman et al. | 340/573.1 |
| 6,735,479 | B2 | 5/2004 | Fabian et al. | |
| 2001/0040512 | A1 * | 11/2001 | Hines et al. | 340/825.49 |
| 2003/0204130 | A1 * | 10/2003 | Colston et al. | 600/300 |
| 2003/0227386 | A1 * | 12/2003 | Pulkkinen et al. | 340/573.1 |
| 2004/0145475 | A1 * | 7/2004 | Greenberger | 340/572.1 |
| 2004/0212500 | A1 | 10/2004 | Stilp | |
| 2005/0035862 | A1 * | 2/2005 | Wildman et al. | 340/573.1 |

OTHER PUBLICATIONS

Lamming, M., et al., The Design of a Human Memory Prothesis, The Computer Journal, vol. 37, No. 3, 1994.
Daniel Salber Anind K. Dey and Gregory D. Abowd, The Context Toolkit: Aiding the Development of Context-Enabled Applications, Proceedings of CHI'99, Pittsburg, PA, May 15-20 pp. 434-441, (preprint), ACM Press, New York, NY, 1999.

(Continued)

*Primary Examiner*—Jeffery Hofsass
*Assistant Examiner*—Anne V. Lai

(57) ABSTRACT

An embodiment of a method of identifying a reminder event of the present invention includes receiving identifications over time. Each identification indicates proximity to a place or thing. A log of at least some of the identifications is made. A pattern recognition algorithm is run on the log which recognizes the reminder event. In an embodiment, the pattern recognition algorithm determines that a particular thing was taken by a person from a first place to a second place and the person left the second place without the thing. In another embodiment, the pattern recognition algorithm determines that a person left a first place and arrived at a second place without a particular thing. The person is notified of the reminder event.

10 Claims, 5 Drawing Sheets

OTHER PUBLICATIONS

Mark Weiser, The Computer for the 21st Century, Scientific American, Sep., 1991, pp. 94-104, reprinted in Scientific American, Special Issue, The Computer in the 21st Century, pp. 78-89, Scientific American, Inc, New York, NY, 1991.

William M. Newman, Margery A. Eldridge, and Michael G. Lamming, PEPYS: Generating Autobiographies by Automatic Tracking, Technical Report EPC-1991-106, Rank Xerox Research Centre, Cambridge, United Kingdom, Proceedings of ECSCW'91, Sep. 1991, Amsterdam, Netherlands, pp. 175-188, Kluwer Academic Publishers, New York, NY, 1991.

Mik Lamming, Peter Brown, Kathleen Carter, Margery, Eldridge, Mike Flynn, Gifford Louie, Peter Robinson, and Abigail Sellen, The Design of a Human Memory Prosthesis, Technical Report EPC-1993-119, Rank Xerox Research Centre, Cambridge, United Kingdom, The Computer Journal, vol. 37, Issue 3, pp. 153-163, Oxford University Press, Oxford, United Kingdom, 1994.

Michael G. Lamming, Towards Future Personalised Information Environments, Technical Report EPC-1994-104, Rank Xerox Research Centre, Cambridge, United Kingdom, Proceedings of FRIEND21, '94 International Symposium on Next Generation Human Interface, Feb. 2-4, 1994, Meguro Gajoen, Japan.

Brett Warneke, Sunil Bhave, Smart Dust Mote Core Architecture, CS252, Spring 2000: Project Report, Berkeley Sensor and Actuator Center, Berkeley, CA, 2000.

A. J. Sellen, G. Louie, J. E. Harris, and A. J. Wilkins, What brings Intentions to Mind? An In Situ Study of Prospective Memory, Technical Report EPC-1996-104, Rank Xerox Research Centre, Cambridge, United Kingdom, Memory, vol. 5, No. 4, pp. 483-507, Psychology Press, Brighton, United Kingdom, 1996.

Mik Lamming, and Mike Flynn, "Forget-me-not" Intimate Computing in Support of Human Memory, Technical Report EPC-1994-103, Rank Xerox Research Centre, Cambridge, United Kingdom, Proceedings of FRIEND21'94 International Symposium on Next Generation Human Interface, Feb. 2-4, 1994, Meguro Gajoen, Japan, pp. 125-128.

Michael G. Lamming, and William M. Newman, Activity-based Information Retrieval: Technology in Support of Personal Memory, Information Processing 92, Proceedings of the IFIP 12th World Computer Congress, Madrid, Spain, Sep. 7-11, 1992, pp. 68-81, vol. III: Personal Computers and Intelligent Systems, Elsevier Science, Amsterdam, Netherlands 1992.

Mik Lamming, Denis Bohm, SPECs: Personal Pervasive Systems, Computer, pp. 109-111, IEEE Computer Society, Los Alamitos, CA, Jun. 2003.

Micheal Singer, Smart Dust Collecting in The Enterprise, Oct. 24, 2003, < http://www.internetnews.com/ent-news/print.php/3098551>.

Mik Lamming, Denis Bohm, SPECs: Another Approach to Human Context and Activity Sensing Research, Using Tiny Peer-to-Peer Wireless Computers, Proceedings UbiComp 2003: Ubiquitous Computing: 5th International Conference, Seattle, WA, Oct. 12-15, 2003, Springer-Verlag, Heidelberg.

Martin, T., Wearable and Ubiquitous Computing, Pervasive Computing, IEEE, vol. 2, No. 3, Jul. 2003, pp. 8-12.

* cited by examiner

METHOD OF AND COMPUTER FOR IDENTIFYING REMINDER EVENT

FIELD OF THE INVENTION

The present invention relates to the field of ubiquitous computing. More particularly, the present invention relates to the field of ubiquitous computing where a user seeks to solve a common human problem through the use of the ubiquitous computing.

BACKGROUND OF THE INVENTION

Ubiquitous computing is a vision for the future in which users are surrounded by computers. Some of the computers are seen as taking different forms from a more traditional personal computer. Others of the computers will be embedded into things and places.

An experimental ubiquitous computing system included smart badges, sensors, and a central server. The smart badges were worn by users and emitted identification codes. The sensors, which were connected to the central server, noted the identification codes and the central server kept diaries of locations of the users along with three types of activities: Time spent alone, time spent with others (e.g., meetings), and time spent traveling between locations in the building. Each user's diary of the previous day was e-mailed to the user. It was hoped that the users would find their diaries helpful as a memory aid by indicating where they were on a specific day and at a specific time along with other users that were present.

Another experimental ubiquitous computing system replaced the smart badges with a device having a touch sensitive LCD screen. With this system, users could access their diaries via the touch sensitive screen. As with the previous system, this system provided users with personal diaries of whom they had encountered and where they had been. It was envisioned that a task reminder mechanism could be added to this system, in which a user would enter the task reminder and then at a particular time, upon reaching a particular place, or upon encountering a particular person, the device would issue a reminder. However, it was not envisioned that the system would issue the reminder only upon a lapse of human memory. Instead, the reminder would occur at the particular time, upon reaching the particular place, or upon encountering the particular person. Rather than supporting human memory, such a system would replace human memory. Further, a user attempting to make thorough use of such a system would receive a reminder even though that had not forgotten the task for which they had requested a reminder.

Such systems required static sensors to be connected by wire to a central computer system that collected data and sent alerts back to the wearable units. This made it difficult to deploy the system widely because of the cost of connecting each sensor to the central computer. In some cases it was impractical; for example, when desired to put a sensor in a car, or in a location where telecommunications costs would be prohibitively high. In the case of temporary deployment in the home, people didn't want to have their decor damaged by wires being installed, only to have the equipment removed sometime later leaving unsightly holes in the walls.

In a health care setting, some patients have difficulty with memory. For example, an Alzheimer's patient may fail to remember to occasionally have a drink of water or how to exit a bathroom. In such a setting, it would be advantageous for a caregiver to be given notice when the patient has a lapse of human memory.

What is needed is an improved, easily deployable pervasive computing system.

SUMMARY OF THE INVENTION

The present invention is a method of and computer for identifying a reminder event. According to an embodiment, a method of identifying a reminder event of the present invention includes receiving identifications over time. Each identification indicates proximity to a place or thing. A log of at least some of the identifications is made. A pattern recognition algorithm is run on the log which recognizes the reminder event. In an embodiment, the pattern recognition algorithm determines that a particular thing was taken by a person from a first place to a second place and the person left the second place without the thing. In another embodiment, the pattern recognition algorithm determines that a person left a first place and arrived at a second place without a particular thing. The person is notified of the reminder event.

These and other aspects of the present invention are described in more detail herein.

BRIEF DESCRIPTION OF THE DRAWINGS

The present invention is described with respect to particular exemplary embodiments thereof and reference is accordingly made to the drawings in which.

DETAILED DESCRIPTION OF A PREFERRED EMBODIMENT

According to an embodiment, the present invention comprises a small computer for use in a pervasive computing system. According to another embodiment, the present invention comprises a method of reminding a person upon a lapse of human memory. According to another embodiment, the present invention comprises a method of monitoring a patient by a caregiver.

Figure 1:
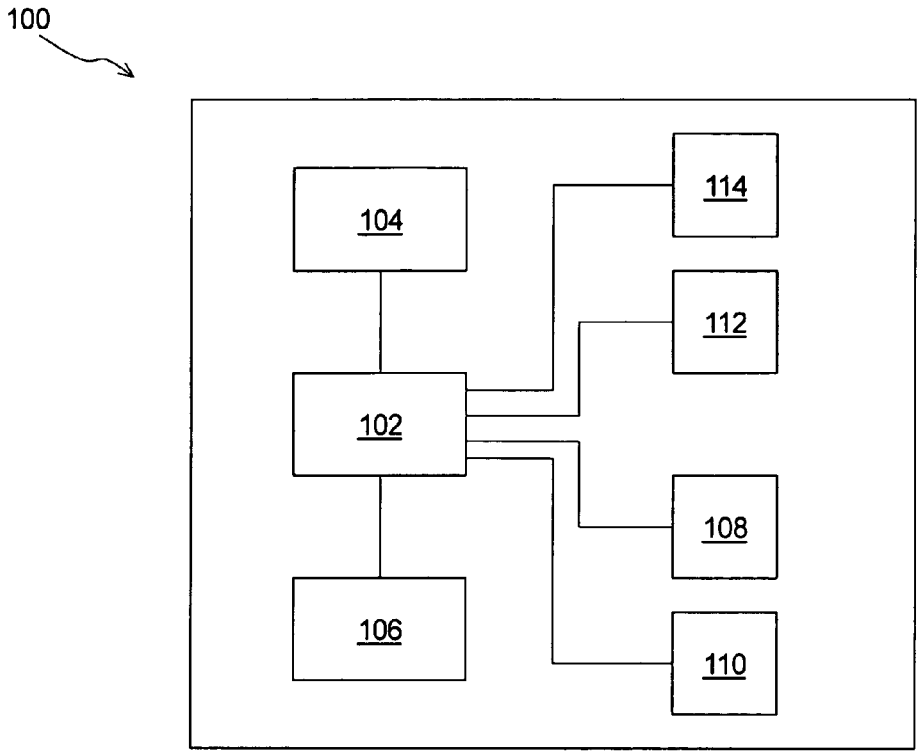
FIG. 1 schematically illustrates an embodiment of a small computer of the present invention.

According to an embodiment, a small computer of the present invention is schematically illustrated in FIG. 1. The small computer 100 comprises a central processing unit 102, a memory 104, a clock 106, a wireless emitter 108, a wireless detector 110, an output device 112, and an input device 114. The central processing unit 102 couples to the memory 104, the clock 106, the wireless emitter 108, the wireless detector 110, the output device 112, and the input device 114. A power device (not shown), such as a battery or a solar cell, provides power to the small computer 100 during operation.

According to an embodiment, the wireless emitter 108 and the wireless detector 110 operate in an infrared band. According to another embodiment, the wireless emitter 108 and the wireless detector operate in another wireless band such as a radio frequency band. According to an embodiment, the output device 112 comprises an LED. Alternatively, the output device 112 comprises another output device such as a sound emitter, a vibration device, or an output screen. For an embodiment of the small computer 100 comprising an output screen, the output screen comprises a display similar to a pager output screen, a PDA (personal data assistant) output screen, or a cell phone output screen.

In operation, the wireless detector 110 receives identifications from other small computers. More particularly, when the small computer 100 is in within the communication range of another small computer 100, a code identifying the other small computer is received. For this purpose, at least one of the small computers 100 is configured to repeatedly emit its identification while another is configured to listen for the emitted identification. Typically, each small computer will have a unique identification, though this is not necessary; thus, some or all of the small computers may emit a common identification code. Also, while not required, all the devices preferably both emit and receive. This means that a single type of device may be provided which tends to make them cheaper to produce. The range or proximity within which one device 100 will detect another is preferably selected to be suitable for the circumstances. For example, where it is desired to determine whether a person having a device 100 clipped to their belt has something with them to which another device 100 is attached (e.g., a backpack), the range is preferably between approximately zero and 6 feet. If the range is too small, the person may in fact have the backpack with them, but it may not be detected. Conversely, if the range is too large, this may result in false indications. For example, the backpack may be detected as being with the person, but in fact, the backpack may be some distance from the person. Similarly, a suitable range is selected where it is desired to determine whether a person having a device 100 is at a particular location where another device 100 is located (e.g., within a house). In this case, the device at the house may be positioned at a strategic location within the house (e.g., near the front door, or in the kitchen) or the range of the device may encompass the entire house. Where it is desired to determine the person's location more particularly (e.g., by determining which of several rooms within a house the person is located) the range should be limited such that the person is not falsely detected as being in a room where the person is not in fact located. Determination of the range should also take into account objects that may block communication between devices 100. For example, where the devices 100 communicate by infrared, the range will generally be limited to line-of-sight, or reflections.

The clock 106 timestamps received identifications. Preferably, the timestamp comprises a real time for a particular identification. The memory 104 stores the identifications and the timestamps in a log. The central processing unit 102 runs a pattern recognition algorithm on the log looking for an event, for example, that the user has forgotten something or that a patient is in distress. Upon finding the event, the central processing unit 102 activates the output device 112, which notifies a user of the event. The user acknowledges receipt of the event via the input device 114.

The event may be recognized by a first device 100 and then passed to a second device 100. Further, a third device may pass notification of the event between the first and second devices. The second device 100 may then notify the user of the event. Once the user acknowledges receipt of the event to the second device 100, the second device 100 may then forward an acknowledgment signal to the first device 100. The second device may be a small computer, but could be, for example, a wristwatch, pager, cell-phone or other device.

Preferably, the small computer 100 is of a size on the order of a pager or smaller. More preferably, the small computer 100 comprises a size on the order of a U.S. dime (i.e., an 18 mm diameter by a 1.4 mm thickness) or smaller. Alternatively, the small computer is larger than the pager. For example, the small computer 100 could be as large as a PDA or a cell phone.

Prototypes of the small computer 100 have been built. The prototypes have a electronics package size of 40×15×14 mm. The prototypes each comprise a microcontroller, a 32 kB memory chip, a real time clock, an infrared emitter, and an infrared detector. The output device 112 of each of the prototypes comprises an LED. The input device 114 of each of the prototypes comprises a button. The microcontroller of the prototypes comprises the central processing unit 102. Each of the prototypes emits a unique 32-bit identifier via its infrared emitter and listens continuously via its infrared detector for other 32-bit identifiers. The prototypes communicate at a data rate of 40 32-bit words per second.

An embodiment of an alternative small computer of the present invention comprises the small computer 100 and an additional wireless detector. The additional wireless detector operates at a different wavelength from the wireless detector 110. For example, a small computer may include an infrared detector and a radio frequency detector.

Figure 2:
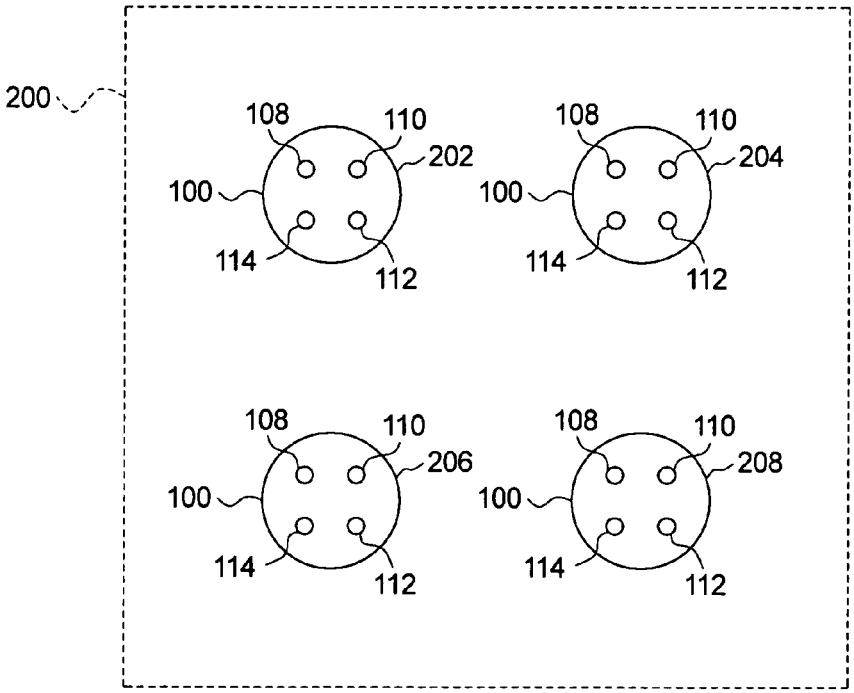
FIG. 2 illustrates an embodiment of a pervasive computing system of the present invention.

According to an embodiment, a pervasive computing system of the present invention is illustrated schematically in FIG. 2. The pervasive computing system 200 comprises a plurality of the small computers 100. As used herein, the term "small computer" refers to a node of the pervasive computing system and although we call it a small computer because that is what we envisage, its overall form-factor does not have to be small. Typically, a first small computer 202 is worn by the user and, thus, is mobile. Second, third, and fourth small computers, 204, 206, and 208, are located at places, attached to things or may be embedded into things. The things to which the small computers are attached may be mobile (such as a person) or immobile (such as a building or piece of hospital equipment). Preferably, the second, third, and fourth small computers, 204, 206, and 208, include the output device 112 and the input device 114. Alternatively, the second, third, and fourth computers, 204, 206, and 208, do not include the output device 112 or the input device 114. According to this alternative, the first small computer includes the capability of notifying the user of the event while the second, third, and fourth small computers, 204, 206, and 208, do not include the capability of notifying the user of the event.

Generally, the first small computer 202 encounters fewer than all of the second, third, and fourth small computers, 204, 206, and 208, at a single time. For example, if the second and third small computers are located at different places, the first small computer 202 (worn by the user) encounters the second small computer 204 at an initial time and later the first small computer 202 encounters the third small computer 206. In contrast, if the fourth small computer 208 is attached to a thing, the first small computer 202 can encounter the second and fourth small computers, 204 and 208, at the initial time and later can encounter the third and fourth small computers, 206 and 208.

Figure 3:
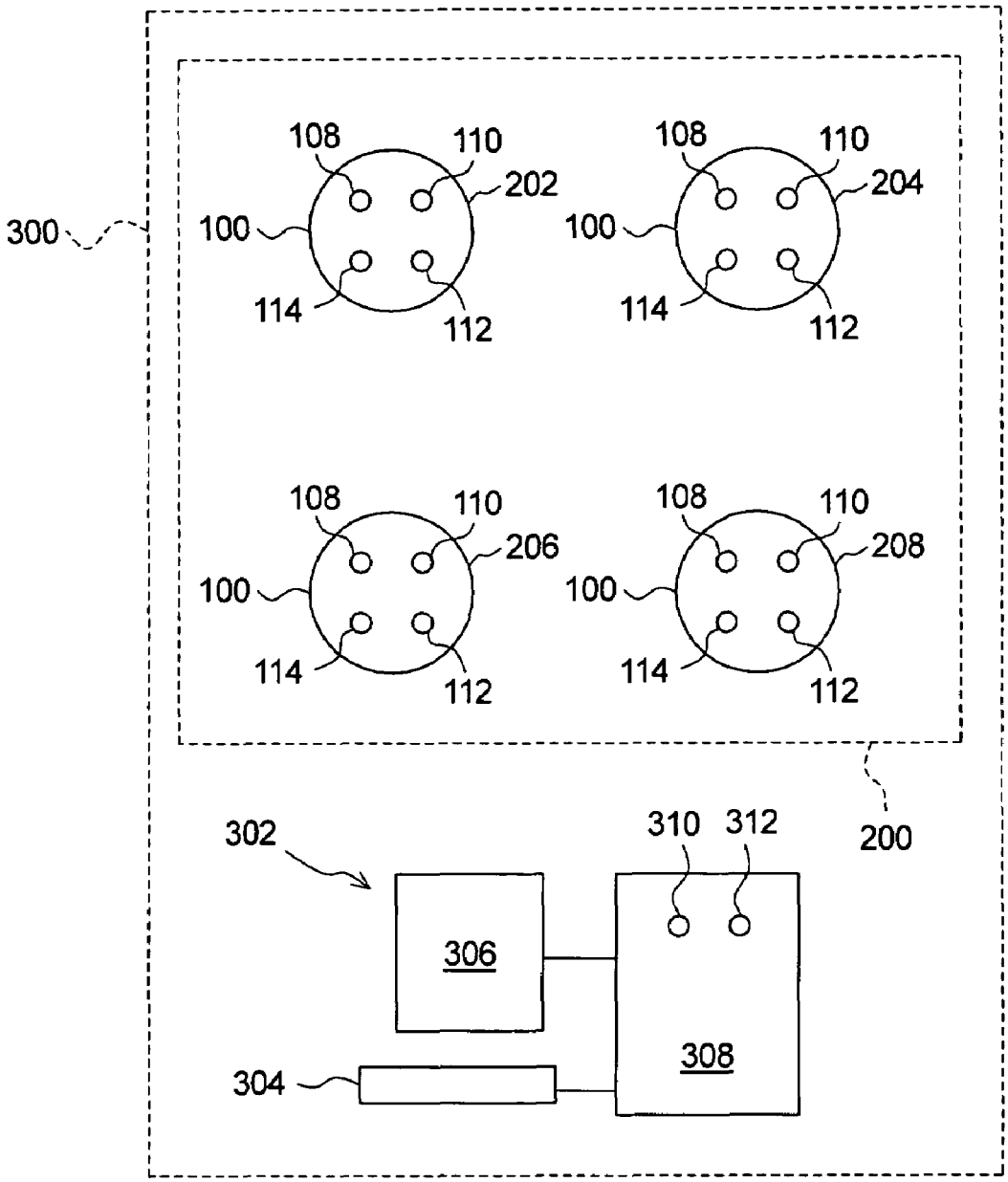
FIG. 3 illustrates an embodiment of an alternative pervasive computing system of the present invention.

An embodiment of an alternative pervasive computing system of the present invention is illustrated in FIG. 3. The alternative pervasive computing system 300 comprises the pervasive computing system 200 and a base computer 302. The base computer 302 may comprise a traditional computer such as a personal computer or a laptop, but more a likely implementation of the base computer may include a portal capable of relaying the uploads to a server such as a web-server. For example, such a portal may comprise a small computer augmented with a second network connection (LAN/Internet/etc). In operation, the portal occasionally communicates via the wireless detector and receiver with one or more of the first through fourth computers to download recent entries and relay them over the second network connection to a network server, for example a web-server, or database service. According to another embodiment shown in FIG. 3, the base computer 302 comprises a keyboard 304, a monitor 306, and a system unit 308. The system unit 308 comprises a base unit wireless detector 310 and a base unit wireless emitter 312. In operation, the base computer 302 occasionally communicates (e.g., via the wireless detector and receiver) with one or more of the first through fourth small computers, 202.208, to download recent log entries and create a database of the log entries. The database can then be accessed by the user for a wide variety of data mining purposes. For example, the data may be used to determine the amount of time spent by one or more of the small computers at various locations. This data may be used, for example, for billing purposes or for productivity analysis. The base computer 302 can also be used to load the pattern recognition algorithm into one or more of the first through fourth small computers, 202 . . . 208.

It should be noted that any of the small computers may include more than one pattern recognition algorithm and multiple pattern recognition algorithms may be active at one time. For example, a small computer may identify when the user has forgotten one of their belongings and may also remind the user to stop at the store and pick up milk.

Figure 4:
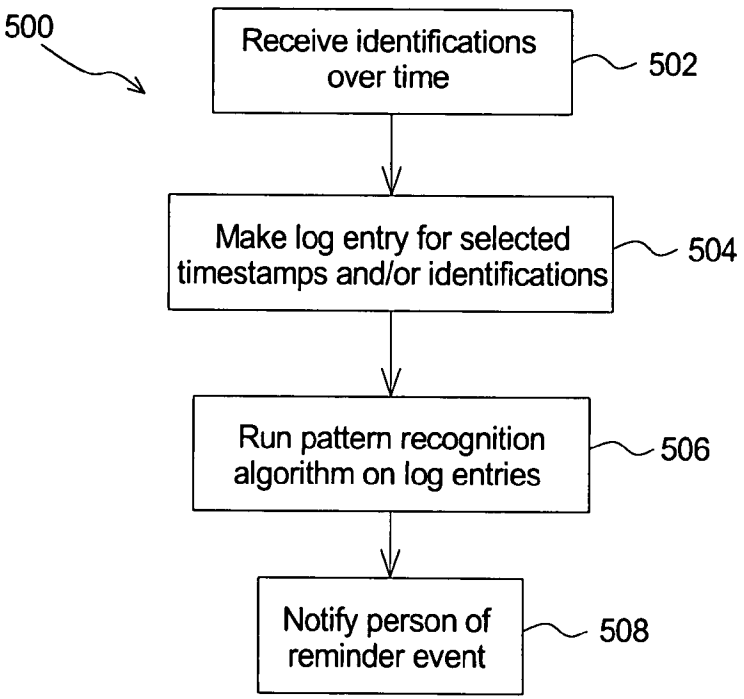
FIG. 4 illustrates an embodiment of a method of reminding a person upon a lapse of human memory of the present invention as a flow chart.

According to an embodiment, a method of reminding a person upon a lapse of human memory is illustrated as a flow chart in FIG. 4. The method 500 begins in a first step 502 in which a first small computer worn by the person receives identifications from other small computers over time. Each of the identifications is unique to a particular small computer emitting the identification.

The person may wear the first small computer in any of a number of ways. For example, the first small computer may be attached to a loop intended to be worn around the user's neck. Or, the first small computer can be clipped the user's shirt or clipped to the user's belt. Or, the first small computer can be attached to a band intended to be worn similarly to a watch.

In a second step 504, a log entry is formed for at least some of identifications. Note that where the user's small computer is in the vicinity of one or more other small computers for a period of time, numerous identifications may be received. While each identification may be logged, this is not necessary. Rather, in one embodiment, only representative identifications may be logged. For example, representative identifications may be include those that indicate a change in the position of the user or in the belongings the user is carrying. Thus, where a particular identification is no longer received, this may indicate that user is no longer in the vicinity of one of their belongings. Thus, a new log entry may be formed under these circumstances.

Further, where a regular, and unbroken sequence of observation are received they can be stored more compactly by simply storing the interval during which the particular identification was received. So for example, a continuous sequence may be stored in a single record of the log as: the identification; the time it was first observed; the time it was last observed before the continuous sequence was broken.

As another example, identifications may be stored periodically (e.g., once per minute or once per hour) where the period is selected based on the circumstances. Similarly, each log entry may include a timestamp, though this is not necessary. Rather, where multiple identifications are each logged, only selected ones may have an associated timestamp, such as those that indicate a change in position or belongings. Further, in some circumstances timestamps may be omitted from the log entirely. For example, the pattern recognition algorithm may operate to detect an event based on a sequence of identifications without regard to the time of day that they occur.

In addition, the pattern recognition algorithm may operate based on historical data stored in the log (e.g., based on a sequence of entries) or may operate based on then-existing detected conditions. For example, an event may be recognized when a specified combination of identifications are received, without regard to whether any of those identifications had previously been detected or logged.

In a third step 506, a pattern recognition algorithm is run on the log entries in search of a reminder event. Upon recognizing the reminder event, the first small computer notifies the user in a fourth step 510.

Figure 5:
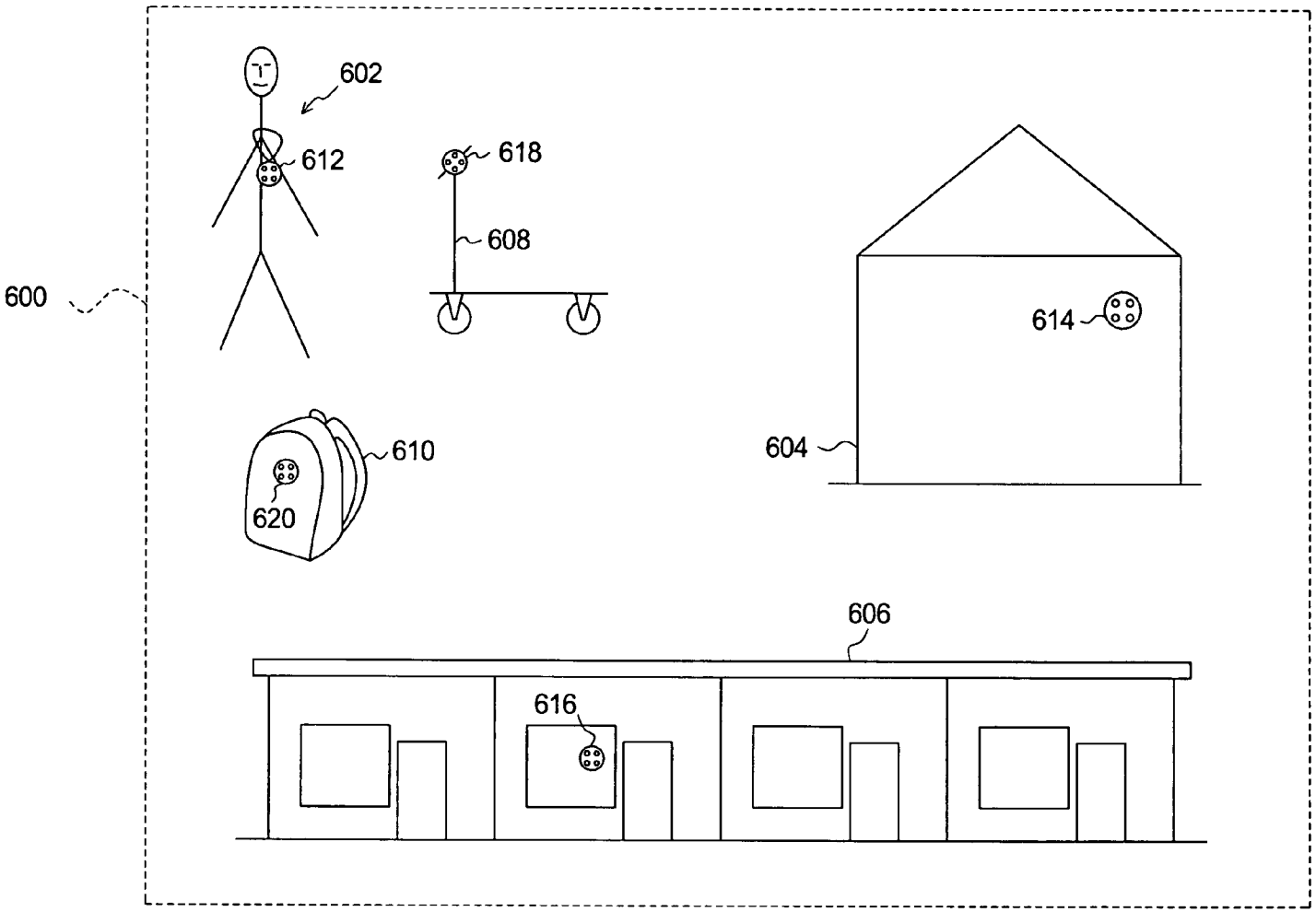
FIG. 5 illustrates a student, some personal belongings of the student, and a portion of the student's environment, which are discussed relative to an embodiment of a method of reminding a person upon a lapse of human memory of the present invention.

Note that in the embodiment described relative to FIG. 5, the device being worn by the user receives identifications from other small computers and the other small computers transmit identifications to the device being worn by the user. Thus, the small computer worn by the user need not include an emitter, while one or more of the other small computers need not include a detector. However, in other embodiments, it may be desired for the device worn by the user to include an emitter so that it may emit identifications to other devices and so that the other devices can perform their own pattern recognition algorithms using those received identifications.

An exemplary embodiment of the method of reminding the person upon the lapse of human memory is discussed relative to a student and some personal items belonging to the student, which are illustrated in FIG. 5. The student 602 lives in a house 604 and attends class at a school 606. The student 602 often rides a scooter 608 to and from the school 606. The student 602 also carries a backpack 610 to and from the school 606. The student wears a first small computer 612. A second small computer 614 is located at the house 604. A third small computer 616 is located at the school (e.g., at the student's desk or at the student's locker). Fourth and fifth small computers, 618 and 620, are attached to the scooter 608 and the backpack 610, respectively.

On a typical school day, the first small computer 612 receives identifications from the second small computer 614 in the morning before the student 602 leaves for the school 606. According to one embodiment, the second small computer 614 is located in a kitchen. So the first small computer 612 receives the identifications while the student eats breakfast. According to another embodiment, the second small computer is located in a garage near where the student 602 keeps the scooter 608. So according to this embodiment, the first small computer 612 receives the identifications from the second small computer 614 when the student 602 retrieves the scooter 608 as the student 602 is leaving for school.

As the student 602 travels from the house 604 to the school 606, the first small computer 612 receives identifications from the fourth and fifth small computers, 618 and 620, indicating that the scooter 608 and the backpack 610 are near the student 602. Upon arriving at the school 606, the student 602 locks the scooter 608 to a rack and places the backpack 610 in a locker. While at the school 606, the first small computer 612 receives identifications from the third small computer 616. When classes are over, the student 602 collects the scooter 608 and the backpack 610 and returns to the house 602.

The first small computer 612 makes log entries for received identifications and possibly also stores timestamps for log entries. The first small computer 612 runs a pattern recognition algorithm which compares the identifications received by the first small computer 612 between leaving the house 604 and arriving at the school 606 to the identifications received after leaving the school 606. If the identifications received after leaving the school 606 are different than the identifications received between leaving the house 604 and arriving at the school 606, the pattern recognition algorithm recognizes a reminder event. In this situation, the reminder event is an item forgotten at the school 606 (i.e., the scooter 608 or the backpack 610). The first computer 612 then notifies the student 602 of the reminder event by a flashing light or another output device such as a beeper or vibrator. It should be recognized that in this example, timestamps are not necessary. However, in other circumstances, timestamps may be used, such as where it is desired to issue a reminder event that is time dependent (e.g., to remind the user to perform a task at a specified time).

Another exemplary embodiment of the method of reminding the person upon the lapse of human memory is to remind a person to pick up milk along the way home from work. The person wears a first small computer. Second, third, and fourth small computers are located at the person's work, the person's home, and the person's market. Upon leaving work, the first small computer runs a pattern recognition algorithm which determines whether the person visits the market prior to arriving at home. If not, the first small computer recognizes not visiting the market as a reminder event and the first small computer notifies the person of the reminder event via an output device of the first small computer.

Figure 6:
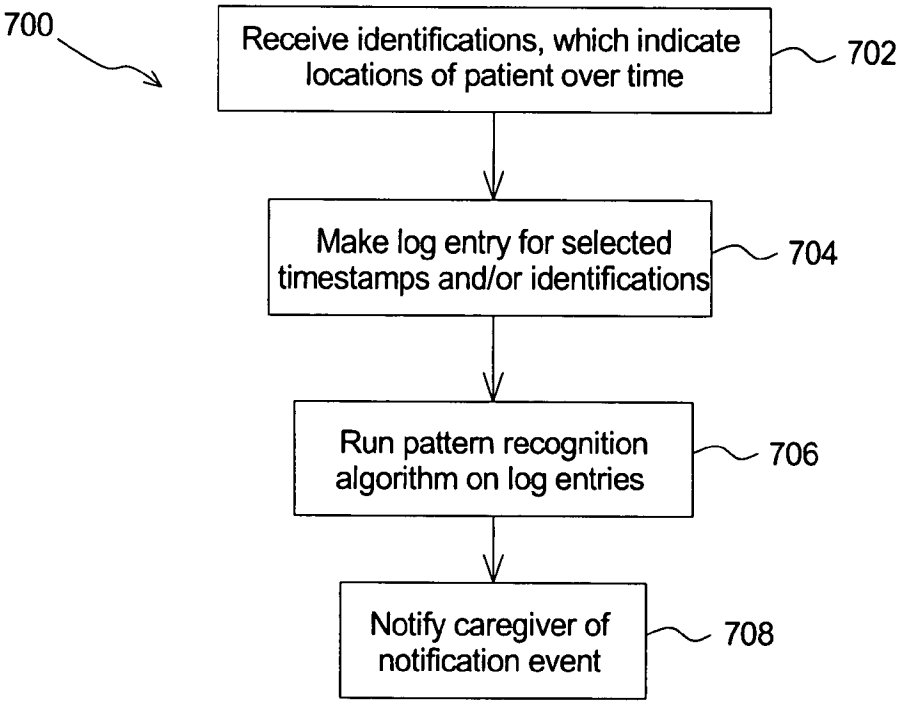
FIG. 6 illustrates an embodiment of a method of monitoring a patient by a caregiver of the present invention as a flow chart.

According to an embodiment, a method 700 of monitoring a patient by a caregiver is illustrated as a flow chart in FIG. 6. The method 700 begins in a first step 702 in which a first small computer worn by the patient receives locations of the patient over time from a plurality of second small computers over time. The locations are determined by an identification provided to the first small computer and a location of a particular second small computer that sends the identification.

In a second step 704, a log entry is formed for at least some of identifications. Note that where the patient is one location for a period of time, numerous identifications may be received. While all received identification may be logged, this is not necessary. Rather, only representative identifications may be logged. For example, representative identifications may include those that indicate a change in position of the patient. For example, where a different identification is received, this indicates that the patient has moved to a different location. Thus, a new log entry may be formed. As another example, identifications may be stored periodically (e.g., once per minute or once per hour) where the period is selected based on the circumstances. Similarly, each log entry may include a timestamp, though this is not necessary. Rather, where multiple identifications are each logged, only selected ones may have an associated timestamp, such as those that indicate a change in position. Further, in some circumstances timestamps may be omitted from the log entirely. As mentioned, a pattern recognition algorithm may operate to detect an event based on a sequence of identifications without regard to the time of day that they occur. Where a log entry includes an identification and its corresponding timestamp, this may be referred to as a timestamp-identification pair.

In a third step 708, a pattern recognition algorithm is run on the log entries by a coordinating computer in search of a notification event. Upon recognizing the notification event, the caregiver is notified in a fourth step 710. According to an embodiment, the coordinating computer may include the first small computer, worn by the patient. Alternately, the coordinating computer may include one of the plurality of second small computers. According to another embodiment, the coordinating computer may include a third computer worn by the caregiver. Further, according to an embodiment, the second small computers notify the caregiver of the notification event. According to another embodiment, the third small computer worn by the caregiver notifies the caregiver of the notification event.

Where the first small computer acts as the coordinating computer, the second small computers provide the identifications to the first small computer where each of the locations is determined by the particular second small computer that provides the identification.

Figure 7:
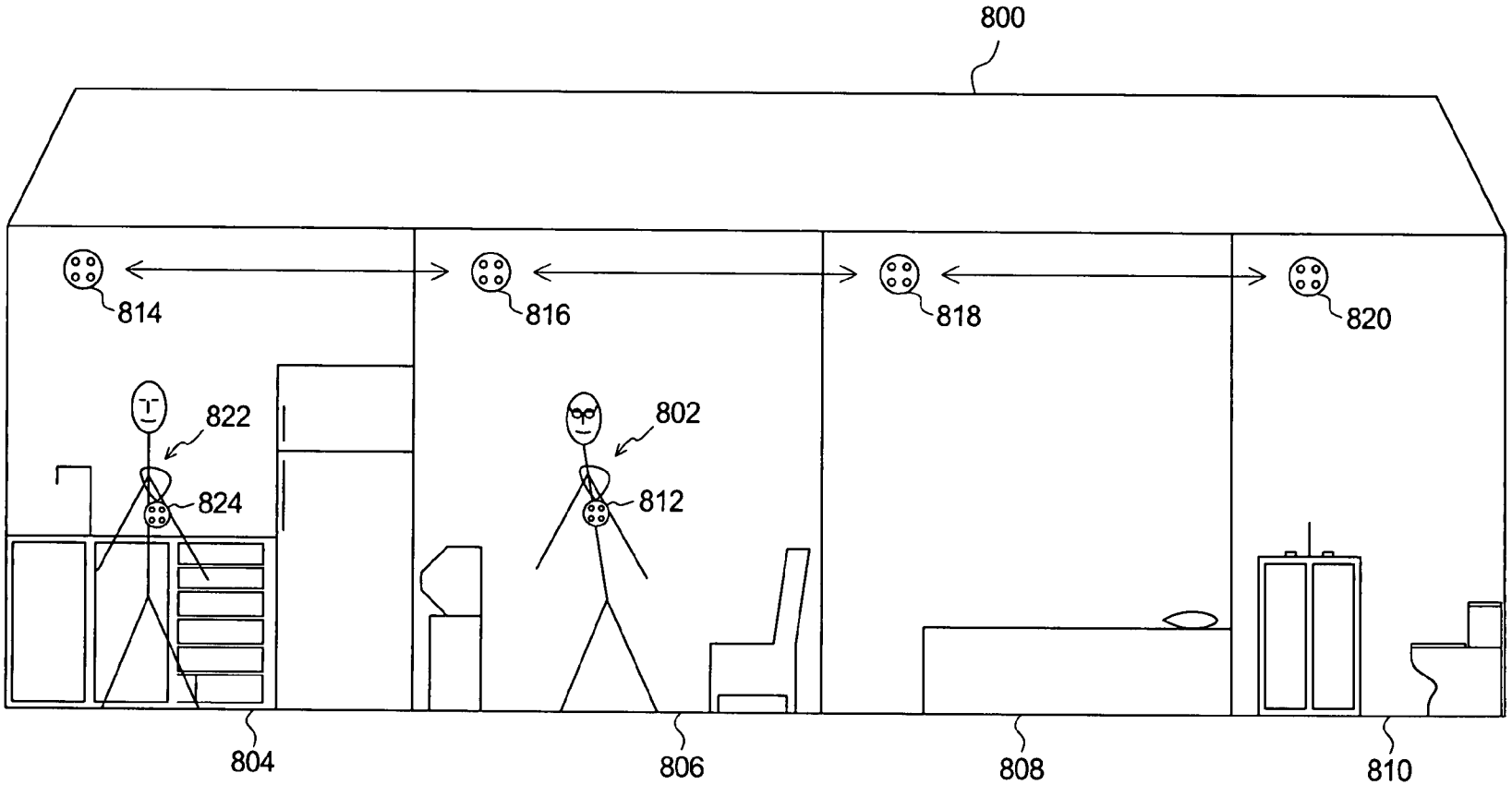
FIG. 7 illustrates an Alzheimer's patient and a home in which the Alzheimer's patient lives, which are discussed relative to an embodiment of a method of monitoring a patient by a caregiver of the present invention.

An exemplary embodiment of the method of monitoring the patient by the caregiver is discussed relative to an Alzheimer's patient and a home in which the Alzheimer's patient lives, which are illustrated in FIG. 7. The Alzheimer's patient 802 lives in the home 800. The home includes a kitchen 804, a den 806, a bedroom 808, and a bathroom 810. The Alzheimer's patient 802 occasionally has trouble remembering to drink water and also has trouble finding his way out of the bathroom 810. The Alzheimer's patient 802 wears a first small computer 812. Second through fifth small computers, 814.820, are located in the kitchen 804, the den 806, the bedroom 808, and the bathroom 810, respectively. A caregiver 822 wears a sixth small computer 824.

As the Alzheimer's patient 802 proceeds through a day, the patient 802 spends time in the various rooms of the home 804. Each of the second through fifth small computers, 824.830, sends identifications to the first small computer 822 depending upon where the patient is located at a particular time. Timestamps are also issued for the identifications and log entries are made.

The sixth small computer 824 runs a pattern recognition algorithm which determines whether the Alzheimer's patient 802 has not been in the kitchen 804 within a few hours, indicating that the Alzheimer's patient 802 has not had a drink of water, or whether the Alzheimer's patient 802 has been in the bathroom 810 for too long, indicating that the Alzheimer's patient 802 may be stuck in the bathroom 810. Upon either of these notification events, the sixth small computer 832 notifies the caregiver 822 via an output device of the sixth small computer 824. The coordinating computer may use radio transmission to alert the caregiver's computer, for example, where there is no line of sight.

The pervasive system of the present invention may thus be used to recognize events including, but not limited to:

alarms intended to alert a caregiver to a situation of concern, such as a patient sitting in front of the TV too long, sleeping too much, pacing between rooms (presumably in pain, or demented), never goes to bed, is continuously going to the toilet, has not been to the kitchen (to get a drink or to eat) for too long, or has not been to the lavatory for too long, etc. The pervasive system may also be used to alert a person that they have forgotten something and may be used for other situation in which a pattern of positional and temporal information can be analyzed to generate an event.

In some cases, the event recognized by a small computer triggers a notification by that small computer. For example, where a small computer worn by a person recognizes that the person has forgotten something, that small computer may notify the person directly. In other cases, the event recognized by a small computer triggers a notification to another device. For example, where a small computer worn by a patient recognizes that the patient needs attention, the notification is forwarded to the small computer worn by a caregiver. In one embodiment, data is collected based on infrared communication between devices; then, when an event is recognized based on the data so collected, the event is communicated via radio communications. This embodiment is particularly useful for patent monitoring where the data indicates the location of the patient throughout the day and is collected via infrared communications, but where the caregiver may be at a different location that is not reachable via infrared communications. If there is no local caregiver, then the information may be received by the portal and relayed over a network (Internet) to some other responsible person. Further, data or events not requiring immediate attention may be relayed over a network. Such an embodiment is expected to provide useful information for healthcare professionals to tailor treatments.

The pervasive system of the present invention may be used to collect data for a variety of purposes. For example, data may be collected by a small computer as it enters and leaves the proximity of other small computers. The data collected by one or more of the small computers may then be uploaded to the base computer 302 (FIG. 3). The base computer 302 may then analyze or "mine" the data for various purposes. For example, were a small computer is worn by service provider (e.g. a health care or social worker) and other small computers are positioned at locations frequented by the service provider (e.g., at the homes of patients) collected data may be analyzed to determined the amount of time spent by the service provider at each of the various locations, such as for billing purposes or for productivity analysis. This embodiment may be used in conjunction with event monitoring based on pattern recognition algorithms. For example, the service provider may be alerted when a patent is determined to be in distress based on data collected by a small computer worn by the patient and may used data collected by a small computer worn by the person's caregiver for billing the patient's insurance provider.

Thus, a pervasive system has been described in which small computers emit signals while one or more others receive them. The small computers require no wired or continuous connection to a central computer, as in prior systems. Thus, the invention is easier to deploy in comparison to such prior systems. For some recognition tasks (like reminding) device being worn by a user can have a pattern downloaded into it, and it can do the recognition by itself, and alert the user via its user interface (e.g., a LED). If more complex analysis is required the data can be uploaded via a portal to a more powerful, base computer. An aspect of this embodiment is that the wearer (the user) acts as a 'mule' carrying the data around until he/she encounters a portal, at which time the wearable will opportunistically make a connection to the base computer and upload the data.

The foregoing detailed description of the present invention is provided for the purposes of illustration and is not intended to be exhaustive or to limit the invention to the embodiments disclosed. Accordingly, the scope of the present invention is defined by the appended claims.

What is claimed is:

1. A computer implemented method of identifying a reminder event comprising steps of:

receiving identifications over time, each identification indicating detection of proximity to a place or a thing;

making a log of at least some of the identifications;

running a pattern recognition algorithm on the log which recognizes the reminder event, said running the pattern recognition algorithm determining that a particular thing was taken by a person from a first place to a second place and that the person left the second place without the thing; and notifying the person of the reminder event.

2. A computer implemented method of identifying a reminder event comprising steps of:

receiving identifications over time, each identification indicating detection of proximity to a place or a thing;

making a log of at least some of the identifications;

running a pattern recognition algorithm on the log which recognizes the reminder event, said running the pattern recognition algorithm determining that a person left a first place and arrived at a second place without a particular thing; and notifying the person of the reminder event.

3. A computer for identifying a reminder event comprising:

a wireless detector operable for receiving identifications, each identification indicating detection of proximity to a place or a thing;

a central processing unit coupled to the wireless detector; and a memory coupled to the central processing unit such that in operation the memory stores a log of selected ones of the identifications and further such that in operation the central processing unit of the computer recognizes the reminder event based upon a pattern recognition algorithm that evaluates the log, said pattern recognition algorithm determining that a particular thing was taken by a person from a first place to a second place and the person left the second place without the thing.

4. The computer according to claim 3, wherein the computer notifies the person of the reminder event.

5. The computer according to claim 3, further comprising an output device coupled to the central processing unit such that in operation the central processing unit activates the output device upon recognizing the reminder event and the output device provides an output signal to the person.

6. The computer according to claim 5, further comprising an input device coupled to the central processing unit such that in operation the person acknowledges receipt of the output signal via the input device.

7. The computer according to claim 3, wherein in operation the central processing unit notifies another computer upon the central processing unit recognizing the reminder event.

8. A computer for identifying a reminder event comprising:

a wireless detector operable for receiving identifications, each identification indicating detection of proximity to a place or a thing;

a central processing unit coupled to the wireless detector; and a memory coupled to the central processing unit such that in operation the memory stores a log of selected ones of the identifications and further such that in operation the central processing unit of the computer recognizes the reminder event based upon a pattern recognition algorithm that evaluates the log, said pattern recognition algorithm determining that a person left a first place and arrived at a second place without a particular thing.

9. A computer readable medium comprising computer code for implementing a method of identifying a reminder event, the method of identifying the reminder event comprising steps of:

receiving identifications over time, each identification indicating detection of proximity to a place or a thing;

making a log of at least some of the identifications;

running a pattern recognition algorithm on the log which recognizes the reminder event, said running the pattern recognition algorithm determining that the person left a first place and arrived at a second place without a particular thing; and notifying a person of the reminder event.

10. A computer readable medium comprising computer code for implementing a method of identifying a reminder event, the method of identifying the reminder event comprising steps of:

receiving identifications over time, each identification indicating detection of proximity to a place or a thing;

making a log of at least some of the identifications;

running a pattern recognition algorithm on the log which recognizes the reminder event, said running the pattern recognition algorithm determining that the person left a first place and arrived at a second place without a particular thing; and notifying a person of the reminder event.

* * * * *

UNITED STATES PATENT AND TRADEMARK OFFICE

CERTIFICATE OF CORRECTION

PATENT NO. : 6,989,753 B1
APPLICATION NO. : 10/734444
DATED : January 24, 2006
INVENTOR(S) : Michael George Lamming et al.

It is certified that error appears in the above-identified patent and that said Letters Patent is hereby corrected as shown below:

In column 5, line 29, delete "202.208" and insert -- 202..208 --, therefor.

In column 8, line 44, delete "814.820" and insert -- 814..820 --, therefor.

In column 8, line 50, delete "824.830" and insert -- 824..830 --, therefor.

Signed and Sealed this

Twenty-fifth Day of August, 2009

David J. Kappos

David J. Kappos
*Director of the United States Patent and Trademark Office*